US008217730B1

(12) United States Patent
Catoiu

(10) Patent No.: US 8,217,730 B1
(45) Date of Patent: Jul. 10, 2012

(54) HIGH POWER WAVEGUIDE CLUSTER CIRCULATOR

(75) Inventor: Miron Catoiu, Kitchener (CA)

(73) Assignee: Raytheon Canada Limited, Ottawa, Ontario ( * ) Notice: Subject to any disclaimer, the term of this patent is extended or adjusted under 35 U.S.C. 154(b) by 0 days.

(21) Appl. No.: 13/085,605

(22) Filed: Apr. 13, 2011

(51) Int. Cl.
*H01P 1/39* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS

| | | | |
|---|---|---|---|
| 3,015,787 | A | 1/1962 | Allin et al. |
| 3,246,262 | A | 4/1966 | Wichert |
| 3,277,400 | A | 10/1966 | Digiondomenico et al. |
| 3,555,459 | A | 1/1971 | Anderson |
| 3,928,824 | A | 12/1975 | Takahashi et al. |
| 3,940,051 | A | 2/1976 | Vaguine et al. |
| 4,205,281 | A | 5/1980 | Nagao |
| 4,633,199 | A | 12/1986 | Stevens et al. |
| 4,717,895 | A | 1/1988 | Pivit et al. |
| 4,904,965 | A | 2/1990 | Blight et al. |
| 5,120,366 | A | 6/1992 | Harada et al. |
| 5,128,635 | A | 7/1992 | Vaughan et al. |
| 5,180,997 | A | 1/1993 | Stern et al. |
| 5,291,290 | A | 3/1994 | Vaughan et al. |
| 5,724,010 | A | 3/1998 | Brown |
| 6,292,068 | B1 | 9/2001 | Martin |
| 7,286,025 | B2 | 10/2007 | Endou et al. |
| 2004/0238796 | A1 | 12/2004 | Abe |
| 2005/0128023 | A1 | 6/2005 | Takahashi et al. |
| 2005/0174187 | A1 | 8/2005 | Ishigaki et al. |
| 2006/0232353 | A1 | 10/2006 | Kroeing |
| 2007/0139131 | A1 | 6/2007 | Kroening |
| 2009/0051363 | A1 | 2/2009 | Feld et al. |

*Primary Examiner* — Stephen Jones

(74) *Attorney, Agent, or Firm* — Daly, Crowley, Mofford & Durkee, LLP

(57) ABSTRACT

A waveguide circulator includes a waveguide junction made from a thermally conductive material and having three ports, and a ferrite cluster housed within the waveguide junction so as to be in communication with the ports. The ferrite cluster includes a plurality of ferrite segments extending from a central point of the ferrite cluster. Each ferrite segment is spaced apart from an adjacent ferrite segments by a gap. Thermal spacers made of a thermally conductive material are disposed in the gaps. Each thermal spacer is thermally coupled to the adjacent ferrite segments and the waveguide junction so as to conduct heat away from the adjacent ferrite segments to the waveguide junction. The ferrite cluster can also be used with other junction circulators including stripline junction circulators designed for high peak power applications.

28 Claims, 10 Drawing Sheets

HIGH POWER WAVEGUIDE CLUSTER CIRCULATOR

TECHNICAL FIELD

The invention relates to junction circulators and in particular to high-power ferrite waveguide circulators for use in Radar Systems, Particle Accelerators and other high RF power applications including space-borne.

BACKGROUND

Radar systems utilize waveguide circulators to route incoming and outgoing signals between an antenna, a transmitter and a receiver. Referring to FIG. 1(*a*), there is a schematic diagram of a dual junction conventional four port circulator 10, which has a first port 12 coupled to a transmitter, a second port 14 coupled to an antenna, a third port 16 coupled to a receiver and a fourth port 17 terminated by a matched load. The circulator 10 routes outgoing signals 13 from the transmitter (e.g. the first port 12) to the antenna (e.g. the second port 14) while isolating the receiver (e.g. the third port 16). Similarly, the circulator 10 routes incoming signals 15 from the antenna (e.g. the second port 14) to the receiver (e.g. the third port 16), while isolating the transmitter (e.g. the first port 12). The circulator routes incoming signals 15 and outgoing signals 13 concurrently (i.e. such that the antenna can transmit and receive signals at the same time). It is to be noted that during the time the transmitter is active (the transmission of a high power RF pulse), the residual power reflected by the antenna is high enough to trigger the receiver protector 19, FIG. 1(*b*). In this case, the circulator junction directly connected to the antenna will have to operate with full reflection at port 16. This is due to receiver protector properties known to those skilled in the art. Also, the circulator must properly operate in the event of excessive antenna reflected power (a failure mode). This last requirement implies that the circulator junction design must be done for a much higher peak RF power than the actual transmitter power.

Waveguide junction circulators are generally designed using one of the junction configurations presented in FIGS. 2(*a*) to 2(*c*). They are equal-ripple Chebyshev designs using partial height ferrite geometries between metal quarter wave transformer plates.

The first configuration shown in FIG. 2(*a*) is reserved for low power circulators and will not be discussed here. The second configuration shown in FIG. 2(*b*) is the basis of prior art commercial waveguide designs. This approach uses two identical ferrites in direct contact with the metallic walls. It is noted that the ferrite height marked as "L" in FIGS. 2(*a*) to 2(*c*) is not the same for the different configurations.

Referring to configuration shown in FIG. 2(*b*), in order to obtain the theoretical circulation conditions required, the gap between the ferrites becomes very small, as an example, around 0.2 inches (5 mm) for a quarter height L-band design. This is also due to the fact that the spacing between the two ferrites not only determine the phase angle of one eigennetwork but also the turn ratio of the ideal transformers used to represent the coupling of the two counter-rotating modes into the ferrite disks and the admittance of the radial quarter wave transformers as indicated in "Design data for Radial-Waveguide Circulators using Partial Height Ferrite resonators", J. Helszajn, F. C. Tan, IEEE Trans. on MTT, vol-23, no. 3, March 1975. This particular aspect limits the maximum peak RF power which circulators designed according to the configuration shown in FIG. 2(*b*) can withstand without breakdown.

High power Radar Systems require circulators that operate not only at high RF peak power, but also at high average RF power due to the high duty cycle used by such systems. Since a microwave ferrite is a poor thermal conductor, a second problem appears, due to the fact that the configuration shown in FIG. 2(*b*) requires a relatively large ferrite diameter. Extreme mechanical stress of the ferrite disks appears due to the large thermal gradient generated by the uneven distribution of magnetic loss across the ferrite volume. This problem is in fact a potential failure mode of FIG. 2 (*b*) configuration and has manifested itself by circulator self-destruction.

Some circulators have been designed to improve performance at high power ratings. For example, U.S. Pat. No. 3,246,262 (Wichert) discloses a device for conducting heat away from a pre-magnetized microwave ferrite using a dielectric material arranged between the ferrite and a hollow conductor. According to one embodiment, Wichert discloses a ferrite body having a triangular cross-section and a longitudinal bore filled with a thermally conductive dielectric material that is in good contact with the ferrite and the hollow conductor. The dielectric material is a good conductor of heat, such as beryllium oxide, and removes heat produced in the ferrite. According to another embodiment, Wichert discloses three cylindrical ferrite bodies positioned so that they mutually touch each other. A hollow space in the center between the ferrite bodies is filled with a thermally conductive dielectric material for removing heat.

One problem with the circulators of Wichert is that the dielectric material removes a large portion of the ferrite from the center of the ferrite junction. Accordingly, the magnetic field tends to have a limited interaction with the ferrite junction, which tends to decrease performance and the circulator may have a limited bandwidth.

Another device is disclosed in United States Patent Application Publication No. 2007/139131 (Kroening). Kroening discloses an improved geometry for ferrite circulators that increases the average power handling by decreasing the temperature rise in the ferrite and associated adhesive bonds. The circulator includes thin dielectric attachments on the sides of the ferrite element, which maximizes the area of contact and minimizes the path length from the ferrite element out to the thermally conductive attachments. The dielectric attachments are made from good thermal conductors, such as boron nitride, aluminum nitride or beryllium oxide, which enables the dielectric attachments to be relatively thin. According to Kroening, these thin dielectric attachments minimize dielectric loading effects without impacting thermal performance.

One problem with the Kroening circulator is that the dielectric attachments are located on the outside of the ferrite element, which provides limited benefits because most of the heat is generated near the center of the ferrite junction due to more significant interactions between the ferrite junction and the magnetic field.

Accordingly, there is a need for improved high power waveguide circulators, and in particular, for improved high peak/average power waveguide circulators for use in Radar Systems.

SUMMARY OF THE INVENTION

According to one aspect of the concepts, circuits and techniques described herein, there is provided a waveguide circulator comprising a waveguide junction made from a thermally conductive material and a ferrite cluster. The waveguide junction has at least three ports. The ferrite cluster is housed within the waveguide junction so as to be in communication with the ports. The ferrite cluster comprises a plurality of ferrite segments arranged around a central point of the ferrite cluster. Each adjacent pair of the ferrite segments is spaced apart by a gap. The ferrite cluster also comprises a plurality of thermal spacers made of a thermally conductive dielectric material. Each of the thermal spacers extends radially from the central point of the ferrite cluster and fills the gap between two adjacent ferrite segments. Each thermal spacer is also thermally coupled to the two adjacent ferrite segments and the waveguide junction so as to conduct heat away from the two adjacent ferrite segments along a thermal path extending through the thermal spacer and to the waveguide junction.

The ferrite segments and the thermal spacers may be configured such that, when a static magnetic field is applied across the ferrite cluster, a radio frequency magnetic field created within the ferrite cluster has a maximum intensity in close proximity to the thermal spacers.

According to another aspect of the concepts, circuits and techniques there is provided a waveguide circulator comprising a waveguide junction made from a thermally conductive material and a ferrite cluster. The waveguide junction has three ports. The ferrite cluster is housed within the waveguide junction so as to be in communication with the three ports. The ferrite cluster comprises a plurality of triangular ferrite segments. Each adjacent pair of the ferrite segments is spaced apart by a gap. The ferrite cluster also comprises a plurality of thermal spacers made of a thermally conductive material. Each of the thermal spacers is disposed in at least one gap. Each thermal spacer is also thermally coupled to the two adjacent ferrite segments and the waveguide junction so as to conduct heat away from the two adjacent ferrite segments to the waveguide junction.

In one embodiment the ferrite cluster is provided from six triangular ferrite segments arranged around a central point of the ferrite cluster. In one embodiment, the triangular ferrite segments are arranged to provide 60 degree symmetry.

The triangular ferrite segments may be sized and shaped such that the ferrite cluster has a hexagonal shape.

In one embodiment, the ferrite cluster includes six thermal spacers made of a thermally conductive dielectric material. In one embodiment, each of the thermal spacers extends radially from the central point of the ferrite cluster in a direction radially aligned with one of the ports of the waveguide junction. In one embodiment, each thermal spacer extends radially from the central point of the ferrite cluster and fills the gap between two adjacent ferrite segments. In one embodiment, each thermal spacer forms part of a thermal path extending through which heat is conducted away from the two adjacent ferrite segments to the waveguide junction.

According to another aspect of the concepts, circuits and techniques there is provided a ferrite cluster for use in a waveguide circulator. The ferrite cluster comprises a plurality of ferrite segments arranged around a central point. Each adjacent pair of the ferrite segments is spaced apart by a gap. The ferrite cluster also comprises a plurality of thermal spacers made of a thermally conductive dielectric material. Each of the thermal spacers extends radially from the central point of the ferrite cluster and fills the gap between two adjacent ferrite segments. Each thermal spacer is also thermally coupled to the two adjacent ferrite segments so as to conduct heat away from the two adjacent ferrite segments.

In accordance with a still further aspect of the concepts, circuits and techniques described herein, a waveguide circulator includes a waveguide junction made from a thermally conductive material, the waveguide junction having at least three ports; and a ferrite cluster housed within the waveguide junction so as to be in communication with the ports, the ferrite cluster comprising: (i) a plurality of ferrite segments arranged around a central point of the ferrite cluster, each ferrite segment being spaced apart from an adjacent ferrite segment to provide a plurality of gaps; and (ii) a plurality of thermally conductive spacers, each of the thermally conductive spacers disposed in at least one of said plurality of gaps and being thermally coupled to the adjacent ferrite segments and the waveguide junction.

In one embodiment, the thermally conductive spacers are provided from a thermally conductive dielectric material.

In one embodiment, each of the thermally conductive spacers extend radially from the central point of the ferrite cluster; and each of the thermally conductive spacers fill the gap between two adjacent ferrite segments.

In one embodiment, the thermal spacer is disposed so as to conduct heat away from the adjacent ferrite segments along a thermal path extending through the thermal spacer and to the waveguide junction.

In one embodiment, at least a portion of each thermal spacer comprises the thermal path from the adjacent ferrite segments to the waveguide junction.

Other aspects and features of the concepts, circuits and techniques will become apparent, to those ordinarily skilled in the art, upon review of the following description of some exemplary embodiments.

BRIEF DESCRIPTION OF THE DRAWINGS

The concepts, circuits and techniques will now be described, by way of example only, with reference to the following drawings, in which:

FIG. 1(*b*) is a schematic diagram of a dual junction circulator having a receiver protector;

FIG. 2(*b*) is a schematic diagram of another possible ferrite resonator configuration;

FIG. 2(*c*) is a schematic diagram of yet another possible ferrite resonator configuration;

DETAILED DESCRIPTION OF THE INVENTION

Figure 3:
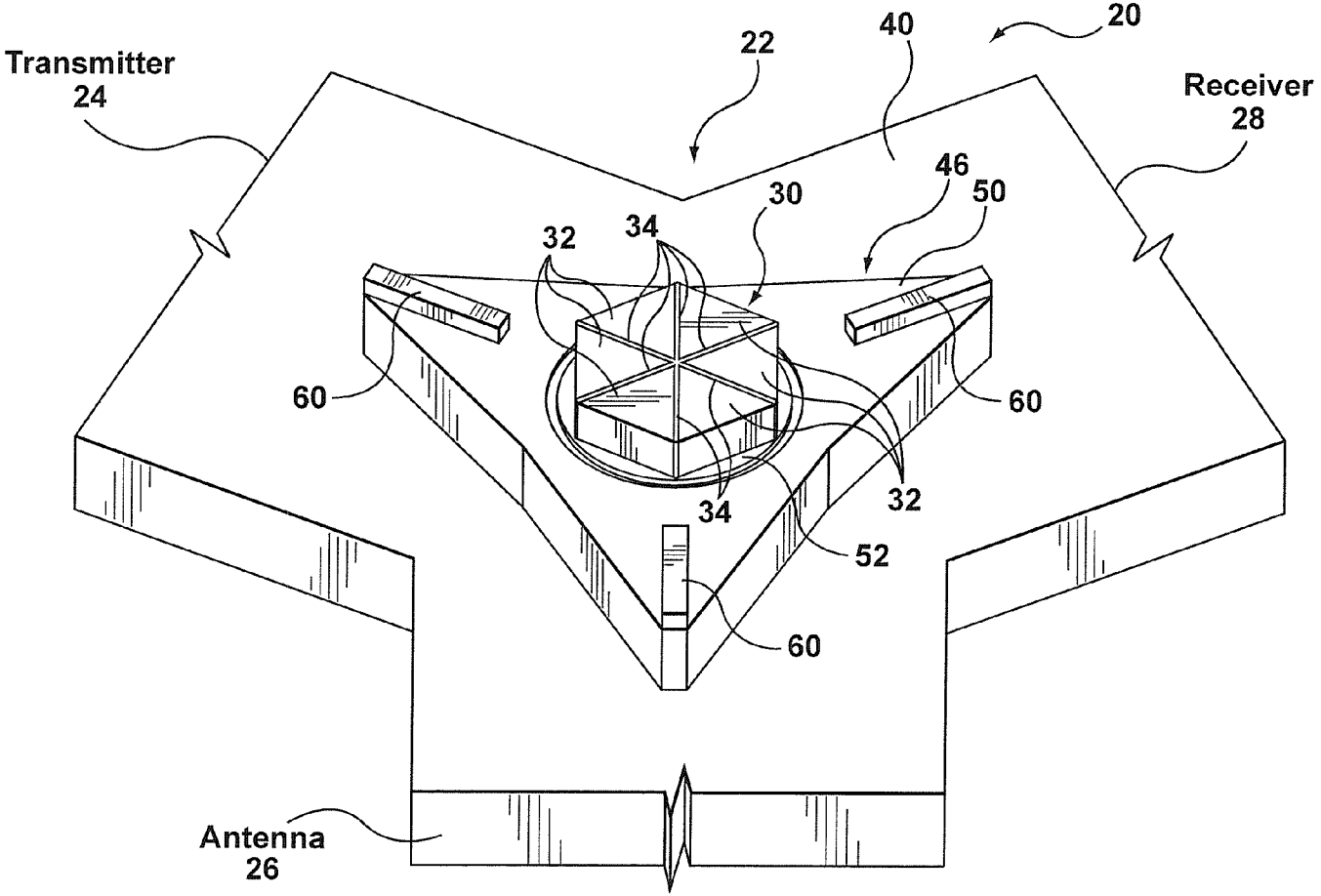
FIG. 3 is a perspective view of a waveguide circulator according to an embodiment of the present invention.
Figure 4:
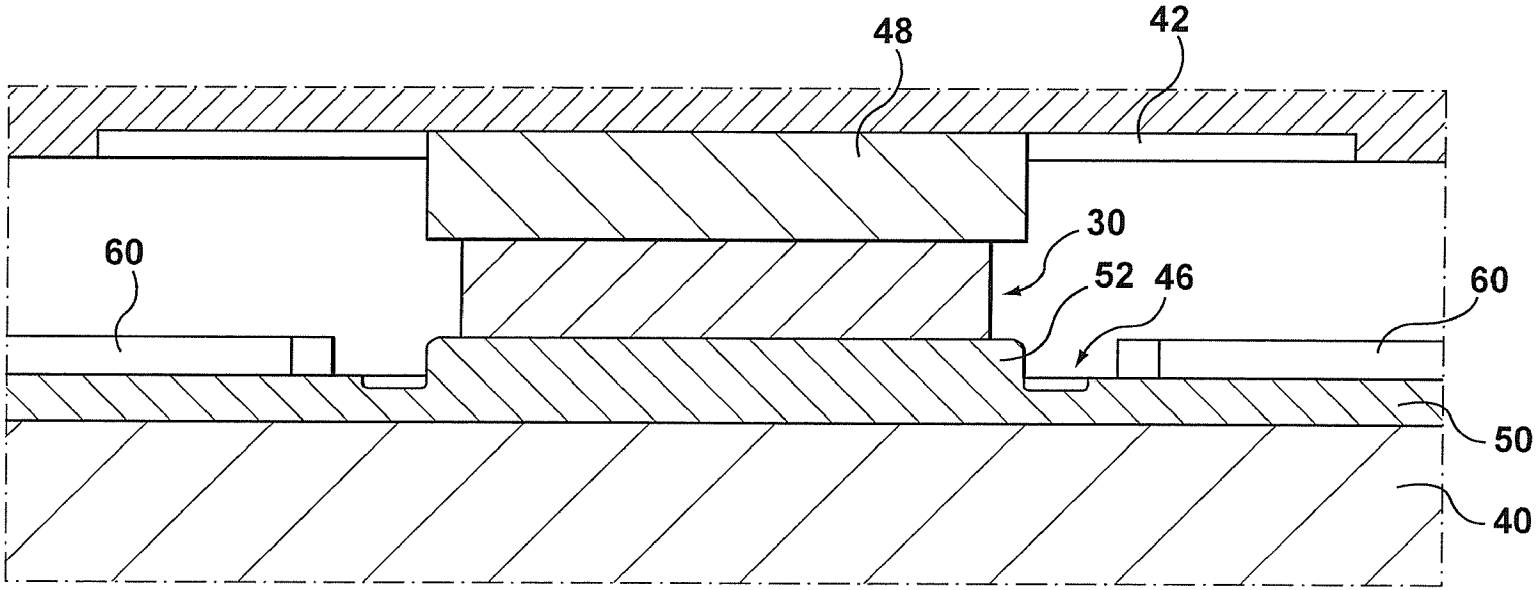
FIG. 4 is a side cross-section view of the waveguide circulator of FIG. 3.

Referring to FIGS. 3 and 4, illustrated therein is an exemplary embodiment of a waveguide circulator 20 made in accordance with the concepts, circuits and techniques described herein. The exemplary waveguide circulator 20 comprises a waveguide junction 22 and a ferrite cluster 30. The waveguide junction 22 has three ports 24, 26, and 28. Furthermore, the waveguide junction 22 may include opposing waveguide walls, for example, a lower waveguide wall 40, and an upper waveguide wall 42 (shown in FIG. 4).

The ferrite cluster 30 is housed within the waveguide junction 22, and in particular, between the lower and upper waveguide walls 40 and 42. More particularly, in the illustrated embodiment, the ferrite cluster 30 is spaced apart from the waveguide walls 40 and 42 using a filler material. As shown in the illustrated embodiment, the filler material may include a disc-shaped dielectric spacer 48 (shown in FIG. 4) between the ferrite cluster 30 and the upper waveguide wall 42. The circulator 20 also includes a pedestal 46 between the ferrite cluster 30 and the lower waveguide wall 40. The pedestal 46 includes a base 50 and a circular riser 52 extending upward from the base 50 underneath the ferrite cluster 30. Generally, the riser 52 positions and supports the ferrite cluster 30. In other embodiments, the filler material and the pedestal may have different shapes and sizes.

In the illustrated embodiment, the circulator 20 also includes three quarter wave transformers 60, which may be integrally formed with the pedestal 46 on the top surface of the base 50. The transformers 60 extend radially outward from the circulator 20 toward each of the ports 24, 26 and 28. The transformers 60 provide impedance matching for electromagnetically coupling the ports 24, 26 and 28 to the ferrite cluster 30.

In use, a magnetic field can be applied across the ferrite cluster 30 such that a signal applied to each port is transmitted to one of the other ports, while isolating the remaining port. For example, a signal applied to the first port 24 is transmitted to the second port 26, while isolating the third port 28. Similarly, a signal applied to the second port 26 is transmitted to the third port 28 while isolating the first port 24, and a signal applied to the third port 28 is transmitted to the first port 24 while isolating the second port 26. In other words, the circulator 20 may couple ports together in a counter-clockwise fashion. Alternatively, the circulator may also couple ports together in a clockwise fashion, for example, by reversing the polarity of the magnetic field across the ferrite junction.

In some embodiments, the waveguide circulator 20 may be used with a radar system such that the first port 24 is coupled to a transmitter, the second port 26 is coupled to an antenna, and the third port 28 is coupled to a receiver.

While the waveguide junction 22 of the illustrated embodiment has three ports 24, 26, and 28, in other embodiments the waveguide junction 22 might have a different number of ports, for example, four or more ports.

Figure 5:
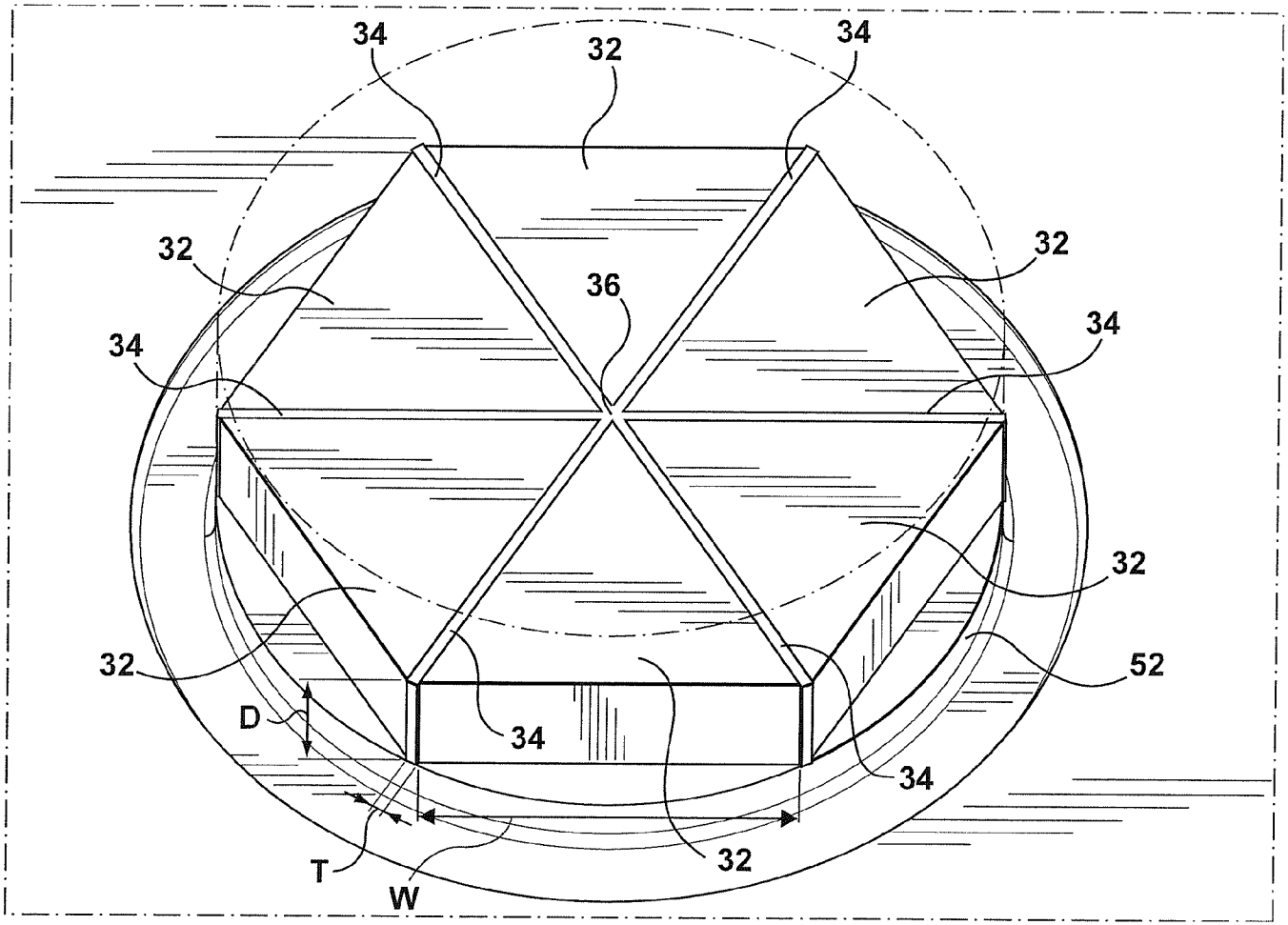
FIG. 5 is a close up perspective view of a ferrite cluster of the waveguide circulator of FIG. 3.

Referring now to FIG. 5, the ferrite cluster 30 comprises a plurality of ferrite segments 32 spaced apart from each other by gaps, and a plurality of thermal spacers 34 filling the gaps between the ferrite segments 32.

The ferrite segments 32 are arranged around a central point 36 of the ferrite cluster 30, and are generally aligned within a plane. In the illustrated embodiment, there are six triangular ferrite segments 32. Each triangular ferrite segment 32 increases in width as it extends radially outward relative to the central point 36. The triangular ferrite segments 32 are also angularly spaced apart from each other so as to provide radially extending gaps between adjacent ferrite segments, which are filled with the thermal spacers 34. In other embodiments, there may be a different number of ferrite segments 32 with different shapes and sizes, as will be described below.

The thermal spacers 34 are located internally within the ferrite cluster 30 and extend radially outward from the central point 36 of the ferrite cluster 30. In the illustrated embodiment, there are six thermal spacers 34 shaped as thin slabs extending radially outward from the central point 36. Furthermore, the six thermal spacers 34 are all adjoined at the central point 36 of the ferrite cluster 30 and form a star-shaped pattern that fills the gaps between the six triangular ferrite segments 32. In other embodiments, there may be a different number of thermal spacers 34 depending on the number, size and shape of the ferrite segments 32.

The thermal spacers 34 are made of a thermally conductive dielectric material with much higher thermal conductivity than the ferrite segments 32 such as aluminum nitride. In other embodiments, the thermal spacers 34 may be made from other dielectric materials such as boron nitride, beryllium oxide, and the like.

The thermal spacers 34 are thermally coupled to the adjacent ferrite segments 32 and to the waveguide walls 40 and 42 so as to conduct heat away from the ferrite segments 32 along a thermal path extending through the thermal spacer 34 and to the waveguide walls 40 and 42. Without the thermal spacers 34, heat generated within the ferrite segments 32 would travel through the full thickness of the ferrite segments 32 before reaching the waveguide junction 22. The use of the star-shaped thermal spacers tends to reduce the operating temperature of the ferrite cluster 30, and enables the circulator 20 to be used at higher power ratings in comparison to conventional ferrite circulators.

In the illustrated embodiment, the ferrite segments 32 are arranged to provide 60° symmetry. More particularly, as shown in FIG. 3, the ferrite cluster 30 is configured such that the thermal spacers 34 are radially aligned with the three ports 24, 26, and 28. Arranging the ferrite segments 32 and the thermal spacers 34 in this way tends to further improve heat dissipation from the ferrite cluster 30. In particular, the location of the maximum RF magnetic fields is intentionally displaced in close proximity to the thermal spacers 34.

Figure 6:
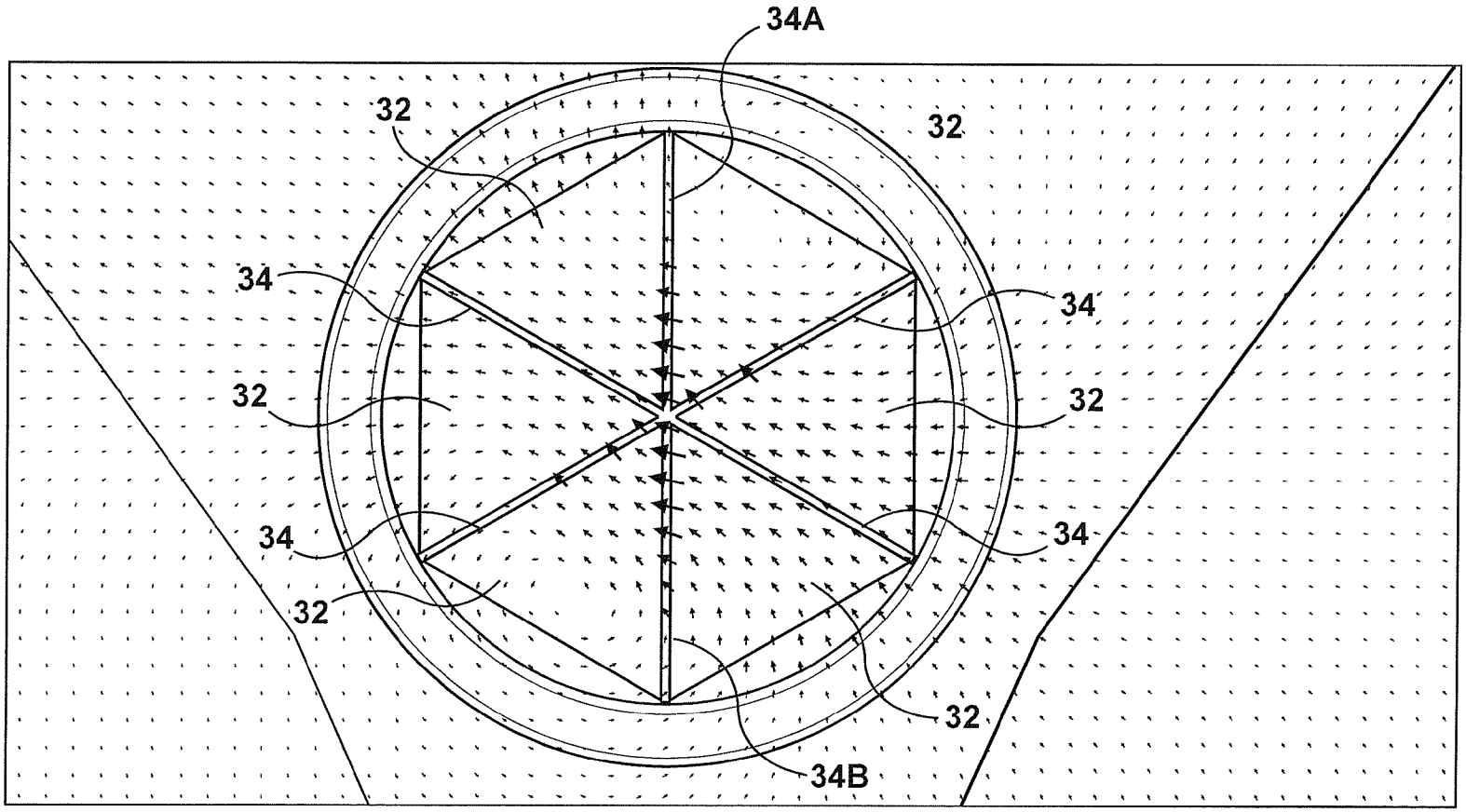
FIG. 6 is a top plan view of the ferrite cluster of FIG. 3 showing a schematic representation of the RF magnetic field across the ferrite cluster.

For example, referring to FIG. 6, illustrated therein is a computer simulation of the RF magnetic field along the H-plane. As shown, the maximum field intensity is located along the thermal spacers 34A and 34B. These maximum RF fields are generated by the magnetic material discontinuities inside the ferrite cluster 30, and tend to align the maximum values of the circularly polarized RF magnetic fields along the discontinuity formed by the thermal spacers. In particular, the magnetic material discontinuities are present because the aluminium nitride thermal spacers 34 have a magnetic permeability equal to the vacuum permeability. The step in magnetic permeability at the ferrite-thermal spacers 34 interface tends to provide a corresponding increase in magnitude for the RF magnetic fields, and as such, the maximum RF magnetic fields tend to be located within the thermal spacers 34. Accordingly, the position of the thermal spacers 34A and 34B tend to be inline with the location of maximum heat generation inside the ferrites and the thermal spacers 34A and 34B provide a short thermal path to the waveguide walls 40 and 42 for conducting heat away from the ferrite cluster 30.

The thermal spacers 34 are generally sized, shaped, and configured to minimally affect the interaction between the ferrite cluster 30 and the RF magnetic field, which might otherwise reduce the bandwidth of the circulator 20. In particular, during operation, RF magnetic fields tend to interact with the ferrite material closer to the central point 36 of the ferrite cluster 30 and less with the outer radial edges of the ferrite cluster 30. In view of this, the thermal spacers 34 generally have a thin cross-section and represent a minimal intrusion on the ferrite material close to the central point 36 of the ferrite cluster 30, which tends to minimally affect the interaction between the ferrite cluster 30 and the RF magnetic field. Referring again to FIG. 6, the distribution of the RF magnetic field within the ferrite cluster 30 is distributed almost symmetrically along the thermal spacers 34A and 34B. This tends to provide a more uniform thermal distribution throughout the ferrite cluster 30 in comparison to conventional circulators, which tends to reduce or eliminate thermal stress within the ferrite cluster 30, particularly at high power ratings.

Figure 7:
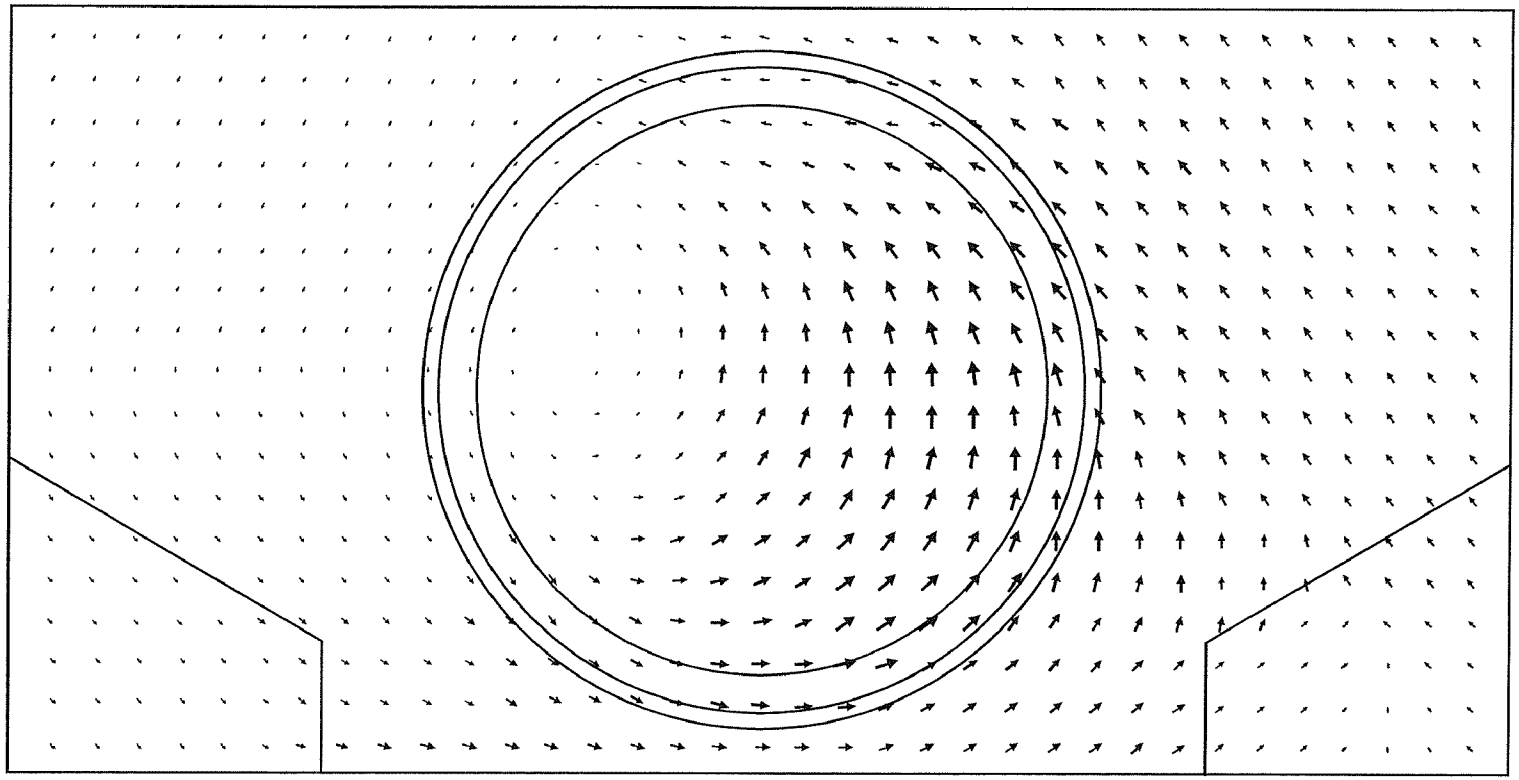
FIG. 7 (PRIOR ART)
FIG. 7 is a top plan view of a prior art ferrite disc showing a schematic representation of the RF magnetic field across the ferrite disc.

In contrast, conventional solid ferrite discs used in prior art circulators have an RF magnetic field that is concentrated within one half of the disc, for example, as illustrated in the simulation shown in FIG. 7. This uneven distribution of the RF magnetic field corresponds to an uneven magnetic RF loss, which generates uneven thermal expansion and significant mechanical stress within the disc, which can cause the ferrite disc to fracture or otherwise fail.

Figure 8:
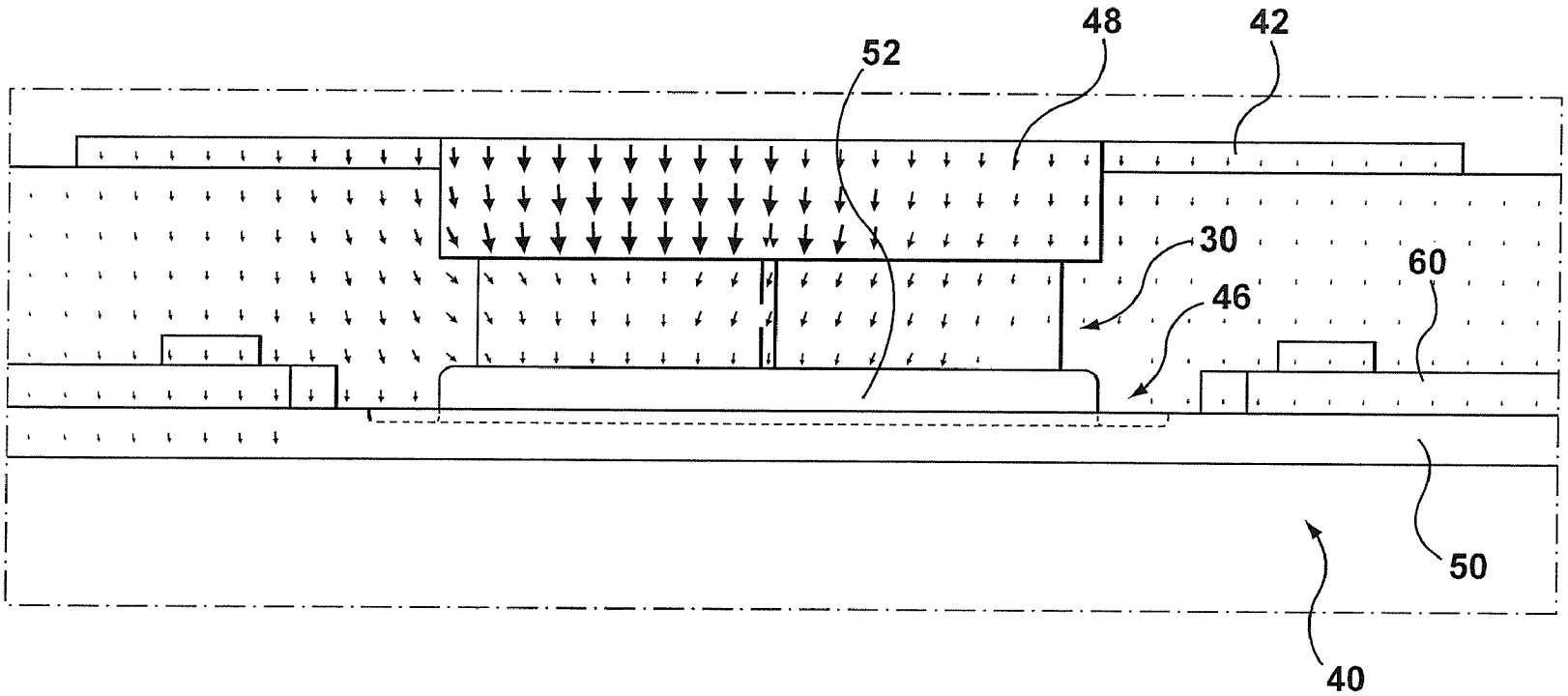
FIG. 8 is a side elevation view of the waveguide circulator of FIG. 3 showing a schematic representation of the electric field across the circulator.

Referring now to FIGS. 4 and 8, the waveguide circulator 20 includes a filler material (e.g. the dielectric spacer 48) that spaces the ferrite cluster 30 apart from the upper waveguide wall 42. The filler material may also help conduct heat away from the ferrite cluster 30. In particular, the filler material may have good thermal conductivity. For example, the dielectric spacer 48 may be made from or Fluoroloy H™. As a result, heat generated within the ferrite cluster 30 dissipates to the upper waveguide wall 42 through the dielectric spacer 48. In other embodiments, the filler material may be made of other thermally conductive materials.

Furthermore, the pedestal 46 may be made of a thermally conductive material that has a higher conductivity than ferrite such as aluminium. Accordingly, the pedestal 46 may also help dissipate heat through the lower waveguide wall 40.

Using a thermally conductive filler material and thermally conductive pedestal 46 tends to provide additional thermal paths for dissipating heat from the ferrite segments 32 to the waveguide walls 40 and 42, in comparison to using the thermal spacers 34 alone. In particular, one set of thermal paths extend from the ferrite segments 32, through the thermal spacers 34, through the dielectric spacer 48 and/or the pedestal 46, and then to the waveguide walls 40 and 42. Another set of thermal paths extend from the ferrite segments 32, through the dielectric spacer 48 and/or the pedestal 46, and then to the waveguide walls 40 and 42 without going through the thermal spacers 34. Providing an additional set of thermal paths directly through the dielectric spacer 48 and/or the pedestal 46 tends to increase the thermal performance of the circulator 20.

Figure 1A:
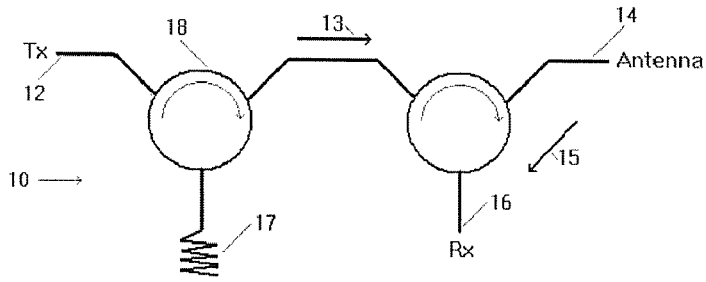
FIG. 1(a) PRIOR ART
FIG. 1(*a*) is a schematic diagram of a dual junction circulator as used in a radar system.
Figure 1B:
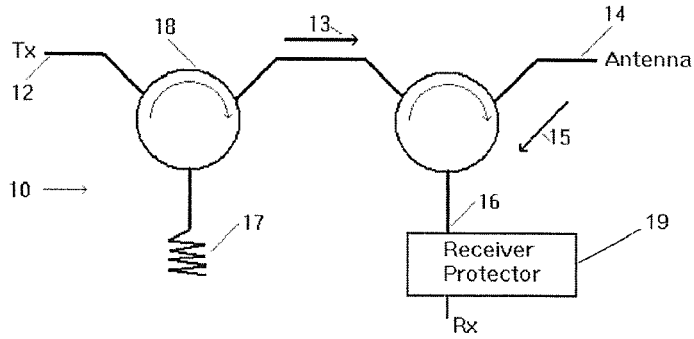
FIG. 1(b) PRIOR ART
Figure 2A:
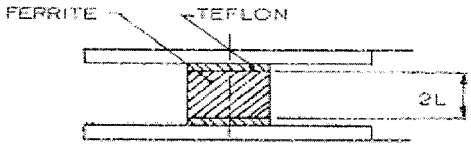
FIG. 2(a) PRIOR ART
FIG. 2(*a*) is a schematic diagram of a possible ferrite resonator configuration.
Figure 2B:
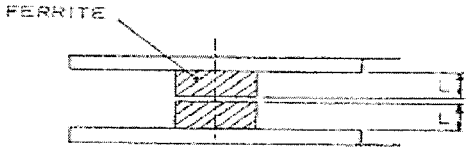
FIG. 2(b) PRIOR ART
Figure 2C:
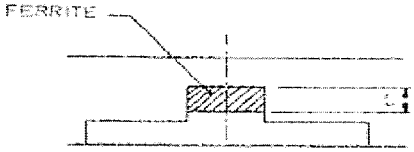
FIG. 2(c) PRIOR ART

Furthermore, when using the circulator 20 in the configuration shown in FIG. 2(*c*), filler material may be positioned such that the RF electric field is concentrated within the filler material, opposed to being concentrated within the ferrite cluster 30. This is in sharp contrast with the prior art circulators that use the configuration shown in FIG. 2(*b*) where the maximum values of the RF electric field are concentrated in the small gap between the ferrites. Since the ratio of the ferrite permittivity to the air permittivity is very high (e.g. greater than a factor of 12), prior art circulators that use the configuration shown in FIG. 2(*b*) tend to fail by arcing at the cylindrical air-to-ferrite interface, for example, when operated at very high peak RF input powers. This arcing does not occur when using the circulator 20 in the configuration of FIG. 2(*c*) because the maximum values of the electric field are located in a dielectric, outside the ferrite cluster. For example, referring to FIG. 8, there is a cross-sectional view of the circulator 20 showing the RF electric field distribution along the E-plane. As shown, the maximum RF electric field is concentrated within the dielectric filler 48, and not in a cylindrical air-to-ferrite interface where two metallic disks in close proximity exist (prior art). This tends to improve the peak power capability of the circulator 20. In particular, the ferrite cluster junction itself tends to be less of a limiting factor for peak power operation. Instead, waveguide discontinuities tend to have a greater influence on peak power.

As an example, simulations and tests were conducted for an L-band quarter height junction circulator using a ferrite cluster described above. Referring to FIG. 5, the circulator 20 included a ferrite cluster 30 formed by triangular ferrite segments 32 having a base width W of about 1.1 inches, and a depth D of about 0.38 inches. The ferrite cluster 30 included thermal spacers 34 made of aluminum nitride having a thickness T of about 0.05 inches and a depth of about 0.38 inches.

A simulation revealed that the peak power limit is in excess of 400 kW at sea level (quarter height waveguide) and appears to be dictated more by the quarter wave transformers, and less by the ferrite cluster 30, if at all.

Figure 9:
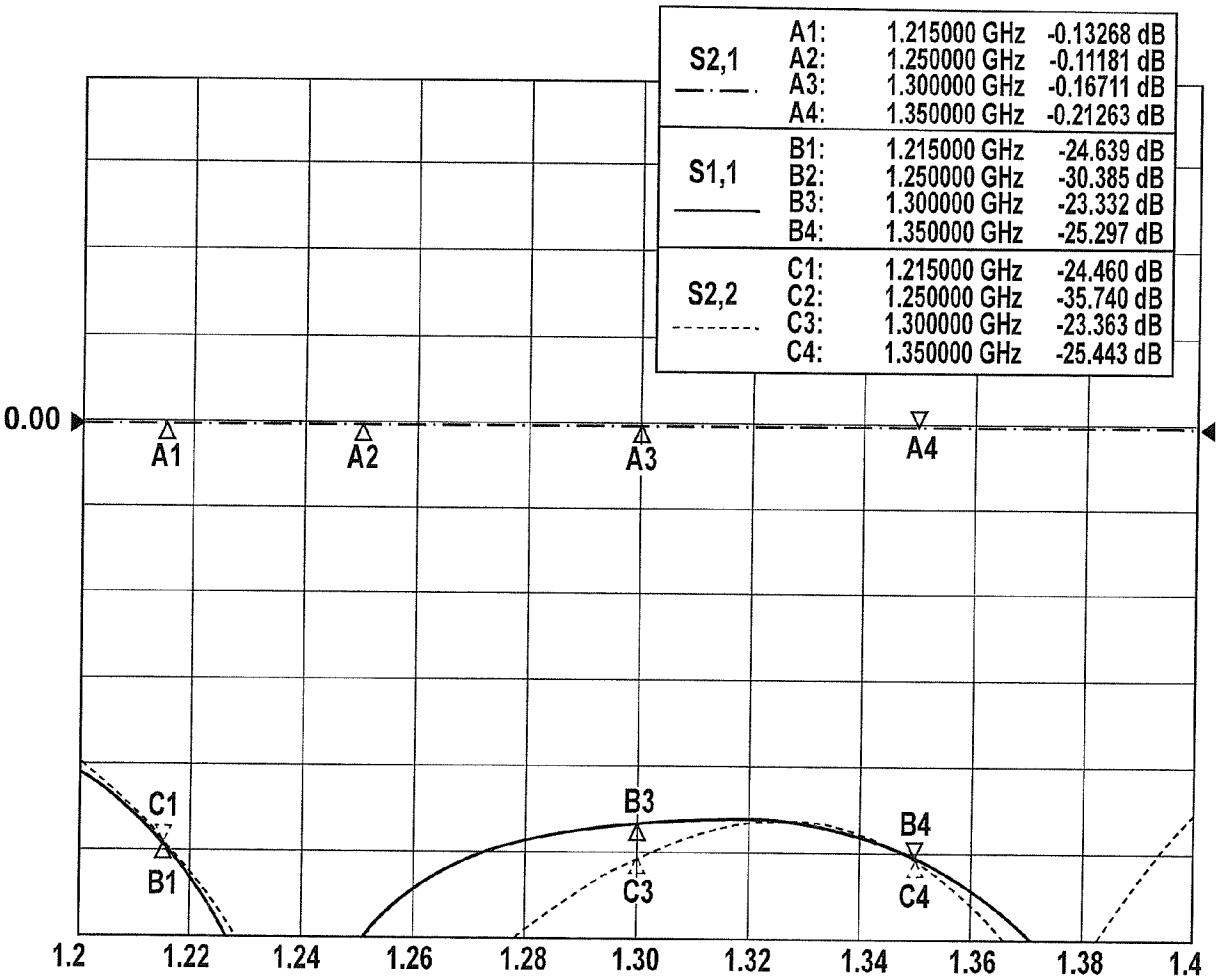
FIG. 9 is a graph illustrating the measured performance for a signal applied to a first port of the waveguide circulator of FIG. 3.

Actual laboratory tests were conducted over a range of frequencies from 1.2 GHz to 1.4 GHz as shown in FIG. 9.

A thermal test was completed with the quarter height waveguide circulator 20 used as an antenna-receiver waveguide circulator on a radar system. The circulator 20 was placed within a vacuum environment having an internal pressure drop corresponding to that of operation at 17,000 feet altitude. The circulator 20 was vacuum operated at about 60 kW peak power and with a 10% duty cycle. Under these conditions, the ferrite cluster 30 reached a temperature of about 44 degrees Celsius, which corresponds to a temperature increase of less than 18 degrees Celsius above ambient. This vacuum mode of operation is equivalent to sea level operation at 275 kW peak power.

Figure 10:
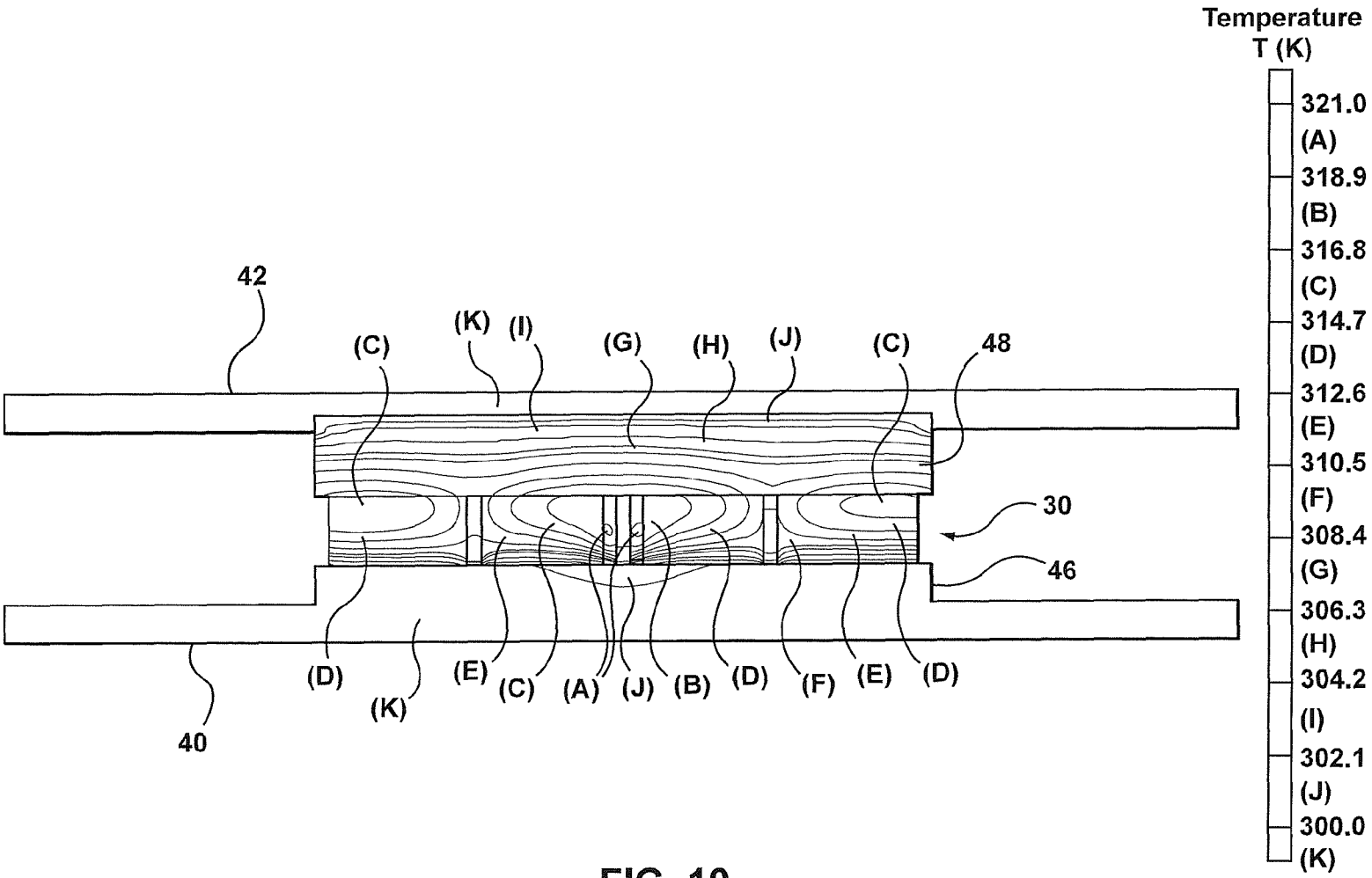
FIG. 10 is a side cross-section view of the waveguide circulator of FIG. 3 showing the temperature distribution through the circulator during operation.

The actual measured temperature performance corresponds to simulated results, which are shown in FIG. 10. In particular, the highest simulated temperature is about 318 Kelvin (i.e. 45 degrees Celsius) and is located within the upper portion of the ferrite cluster 30 near the dielectric spacer 48 as indicated by temperature zones "A" and "B".

Figure 11:
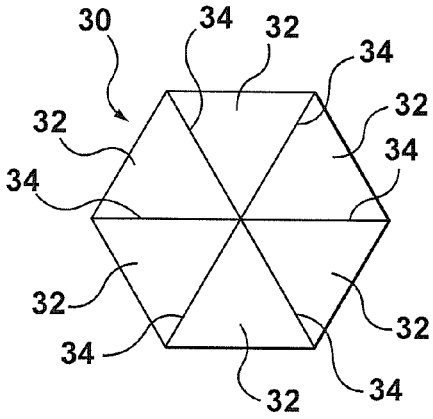
FIG. 11 is a top plan view of the ferrite cluster of the waveguide circulator of FIG. 3.

As shown in FIG. 11, the ferrite cluster 30 of the waveguide circulator 20 includes six triangular ferrite segments 32 spaced apart by six thermal spacers 34. Each triangular ferrite segment 32 has a similar size and shape. Furthermore, the triangular ferrite segments 32 are arranged such that the ferrite cluster 30 has a hexagonal shape.

While one waveguide embodiment has been described and illustrated, other alternative embodiments are possible. For example, the ferrite cluster 30 may be applied to other junction circulators including stripline junction circulators designed for high peak power applications, and junction circulators that operate at critical pressure and high power, such as circulators used in space-borne applications.

The ferrite cluster and the ferrite segments of the junction circulator may also have different shapes and configurations.

Figure 12:
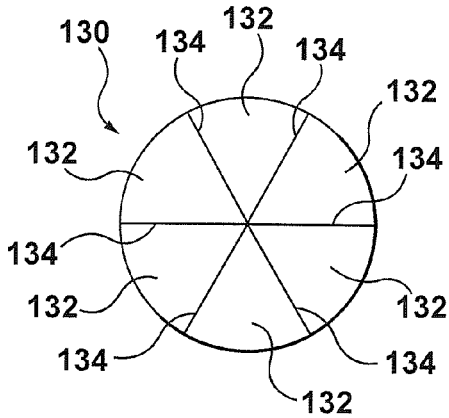
FIG. 12 is a top plan view of a ferrite cluster having a circular shape and six ferrite segments according to another embodiment of the present invention.

For example, referring to FIG. 12, there is a ferrite cluster 130 according to an alternative embodiment.

The ferrite cluster 130 includes six pie-shaped ferrite segments 132 spaced apart by six thermal spacers 134. The ferrite segments 132 are arranged such that the ferrite cluster 130 has a circular shape. Furthermore, the ferrite segments 132 are arranged such that the ferrite cluster 130 has 60° symmetry.

Figure 13:
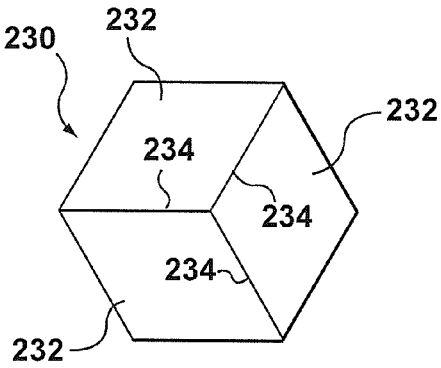
FIG. 13 is a top plan view of a ferrite cluster having a hexagonal shape and three ferrite segments according to another embodiment of the present invention.

In some alternative embodiments, there may be a different number of ferrite segments 32. For example, referring to FIG. 13, there is a ferrite cluster 230 according to another alternative embodiment. The ferrite cluster 230 includes three rhombus-shaped ferrite segments 232 spaced apart by three thermal spacers 234. The ferrite segments 232 are arranged such that the ferrite cluster 230 has a hexagonal shape.

Figure 14:
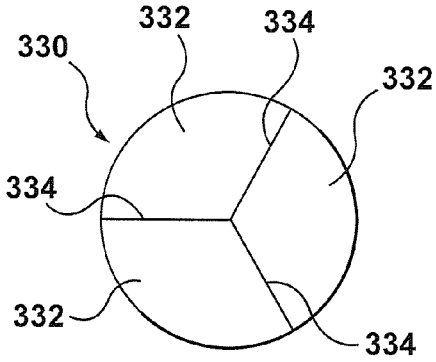
FIG. 14 is a top plan view of a ferrite cluster having a circular shape and three ferrite segments according to another embodiment of the present invention.

Referring to FIG. 14, there is a ferrite cluster 330 according to another alternative embodiment. The ferrite cluster 330 includes three pie-shaped ferrite segments 332 spaced apart by three thermal spacers 334. The ferrite segments 332 are arranged such that the ferrite cluster 330 has a circular shape.

It is noted that the ferrite clusters 230 and 330 both have 120° symmetry. Accordingly, it is possible to align the thermal spacers 234 or 334 with three ports of a three-port junction.

While the embodiments described above illustrate ferrite clusters with six or less ferrite segments, some embodiments may include more than six ferrite segments. For example, the number of ferrite segments may correspond to the number of ports of the waveguide junction being used with the ferrite cluster, or a multiple thereof.

While the embodiments described above illustrate ferrite clusters having hexagonal or circular configurations, some embodiments may include ferrite clusters having different shapes, for example, Y-shaped clusters, and the like.

What has been described is merely illustrative of the application of the concepts, circuits, techniques and principles of the embodiments. Other arrangements and methods can be implemented by those skilled in the art without departing from the spirit and scope of the concepts, circuits, techniques and principles of the embodiments described herein.

The invention claimed is:

1. A ferrite cluster for use in a waveguide circulator, the ferrite cluster comprising:

(a) a plurality of ferrite segments arranged around a central point, each adjacent pair of the ferrite segments being spaced apart by a gap; and (b) a plurality of thermally conductive spacers, each of the thermally conductive spacers filling the gap between two adjacent ferrite segments and being thermally coupled to the two adjacent ferrite segments.

2. The waveguide circulator of claim 1 wherein each of said plurality of thermally conductive spacers are provided from a thermally conductive dielectric material.

3. The waveguide circulator of claim 1 wherein:

the plurality of ferrite segments are arranged around the central point such that each gap formed by the plurality of ferrite segments extends radially from the central point of the ferrite cluster; and each of the thermally conductive spacers extends radially from the central point of the ferrite cluster.

4. The waveguide circulator of claim 1 wherein each of the thermally conductive spacers conducts heat away from the two adjacent ferrite segments.

5. The waveguide circulator of claim 1, wherein the plurality of ferrite segments includes at least three ferrite segments.

6. The ferrite cluster of claim 5, wherein the plurality of thermal spacers comprises at least three thermal spacers, each of the thermal spacers extending radially from the central point of the ferrite cluster and filling the gap between two adjacent triangular ferrite segments.

7. The ferrite cluster of claim 5, wherein the ferrite segments and the thermal spacers are sized and shaped to provide 120 degree symmetry.

8. The ferrite cluster of claim 7, wherein the plurality of ferrite segments includes six triangular ferrite segments arranged to provide 60 degree symmetry.

9. The ferrite cluster of claim 8, wherein the triangular ferrite segments are sized and shaped such that the ferrite cluster has a hexagonal shape.

10. The ferrite cluster of claim 8, wherein the plurality of thermal spacers comprises six thermal spacers, each of the thermal spacers extending radially from the central point of the ferrite cluster and filling the gap between two adjacent triangular ferrite segments.

11. A waveguide circulator comprising:

(a) a waveguide junction made from a thermally conductive material, the waveguide junction having at least three ports; and (b) a ferrite cluster housed within the waveguide junction so as to be in communication with the ports, the ferrite cluster comprising:

(i) a plurality of ferrite segments arranged around a central point of the ferrite cluster, each ferrite segment being spaced apart from an adjacent ferrite segment to provide a plurality of gaps; and (ii) a plurality of thermally conductive spacers, each of the thermally conductive spacers disposed in at least one of said plurality of gaps and being thermally coupled to the adjacent ferrite segments and the waveguide junction.

12. The waveguide circulator of claim 1, wherein said thermally conductive spacers are provided from a thermally conductive dielectric material.

13. The waveguide circulator of claim 1 wherein:

each of the thermally conductive spacers extend radially from the central point of the ferrite cluster; and each of the thermally conductive spacers fill the gap between two adjacent ferrite segments.

14. The waveguide circulator of claim 1 wherein the thermal spacer is disposed so as to conduct heat away from the adjacent ferrite segments along a thermal path extending through the thermal spacer and to the waveguide junction.

15. The waveguide circulator of claim 14 wherein at least a portion of each thermal spacer comprises the thermal path from the adjacent ferrite segments to the waveguide junction.

16. The waveguide circulator of claim 1, wherein the ferrite segments and the thermal spacers are configured such that, when a static magnetic field is applied across the ferrite cluster, a radio frequency magnetic field created within the ferrite cluster has a maximum intensity in close proximity to the thermal spacers.

17. The waveguide circulator of claim 16, wherein at least one of the plurality of the thermal spacers extends radially from the central point of the ferrite cluster in a direction radially aligned with at least one of the ports of the waveguide junction.

18. The waveguide circulator of claim 16, wherein the plurality of ferrite segments includes at least three ferrite segments.

19. The waveguide circulator of claim 18, wherein the plurality of thermal spacers comprises at least three thermal spacers, each of the thermal spacers extending radially from the central point of the ferrite cluster and filling the gap between two adjacent triangular ferrite segments.

20. The waveguide circulator of claim 18, wherein the ferrite segments and the thermal spacers are sized and shaped to provide 120 degree symmetry within the ferrite cluster.

21. The waveguide circulator of claim 20, wherein the plurality of ferrite segments includes six triangular ferrite segments arranged such that the ferrite cluster has 60 degree symmetry.

22. The waveguide circulator of claim 21, wherein the triangular ferrite segments are sized and shaped such that the ferrite cluster has a hexagonal shape.

23. The waveguide circulator of claim 21, wherein the plurality of thermal spacers comprises six thermal spacers, each of the thermal spacers extending radially from the central point of the ferrite cluster and filling the gap between two adjacent triangular ferrite segments.

24. A waveguide circulator comprising:

(a) a waveguide junction made from a thermally conductive material, the waveguide junction having three ports; and (b) a ferrite cluster housed within the waveguide junction so as to be in communication with the three ports, the ferrite cluster comprising:

(i) a plurality of substantially triangular-shaped ferrite segments arranged around a central point of the ferrite cluster, each adjacent pair of the ferrite segments being spaced apart by a gap; and (ii) a plurality of thermally conductive spacers, each of the thermally conductive spacers extending radially from the central point of the ferrite cluster and disposed in the gap between two adjacent ferrite segments and being thermally coupled to the two adjacent ferrite segments and the waveguide junction so as to conduct heat away from the two adjacent ferrite segments along a thermal path extending through the thermal spacer and to the waveguide junction.

25. The waveguide circulator of claim 24, wherein each of the thermal spacers extends radially from the central point of the ferrite cluster in a direction radially aligned with one of the ports of the waveguide junction.

26. The waveguide circulator of claim 24, wherein said plurality of triangular-shaped ferrite segments corresponds to six triangular-shaped ferrite segments and said a plurality of thermally conductive spacers corresponds to six thermally conductive spacers provided from a thermally conductive dielectric material.

27. The waveguide circulator of claim 24, wherein the triangular ferrite segments are arranged to provide 60 degree symmetry.

28. The waveguide circulator of claim 27, wherein the triangular ferrite segments are sized and shaped such that the ferrite cluster has a hexagonal shape.

* * * * *